US006073094A

United States Patent [19]

Chang et al.

[11] Patent Number: 6,073,094

[45] Date of Patent: Jun. 6, 2000

[54] VOICE COMPRESSION BY PHONEME RECOGNITION AND COMMUNICATION OF PHONEME INDEXES AND VOICE FEATURES

[75] Inventors: Lu Chang, Boca Raton; Jian-Cheng Huang, Lake Worth; Robert J. Schwendeman, Pompano Beach, all of Fla.

[73] Assignee: Motorola, Schaumburg, Ill.

[21] Appl. No.: 09/089,081

[22] Filed: Jun. 2, 1998

[51] Int. Cl.[7] ..... G10L 19/14

[52] U.S. Cl. ..... 704/223; 704/207; 704/268

[58] Field of Search ..... 455/563; 379/88.14; 704/221, 222, 223, 254, 204, 224

[56] References Cited

U.S. PATENT DOCUMENTS

| | | | |
|---|---|---|---|
| 4,058,676 | 11/1977 | Wilkes et al. | 704/220 |
| 4,799,261 | 1/1989 | Lin et al. | 704/219 |
| 4,827,516 | 5/1989 | Tsukahara et al. | 704/224 |
| 5,485,543 | 1/1996 | Aso | 704/267 |
| 5,600,703 | 2/1997 | Dang et al. | 455/31.3 |
| 5,636,325 | 6/1997 | Farrett et al. | 704/258 |
| 5,659,597 | 8/1997 | Bareis et al. | 455/563 |
| 5,719,996 | 2/1998 | Chang et al. | 704/256 |
| 5,806,022 | 9/1998 | Rahim et al. | 704/205 |
| 5,828,993 | 10/1998 | Kawauchi | 704/202 |
| 5,905,969 | 5/1999 | Mokbel et al. | 704/203 |
| 5,933,805 | 8/1999 | Boss et al. | 704/249 |

OTHER PUBLICATIONS

Young, Jansen, Odell, Ollason and Woodland, *The HTK Book*, Entropic Cambridge Research Laboratory, Cambridge, England.

Joseph Picone, Continuous Speech Recognition Using Hidden Markov Models, IEEE ASSP Magazine, pp. 26–41, Jul. 1990.

Normandin, Cardin and De Mori, High–Performance Connected Digit Recognition Using Maximum Mutual Information Estimation, IEEE Transactions on Speech and Audio Processing, vol. 2, No. 2, Apr. 1994.

*Primary Examiner*—David R. Hudspeth
*Assistant Examiner*—Donald L. Storm
*Attorney, Agent, or Firm*—James A. Lamb; Eduardo Guntin

[57] ABSTRACT

A communication system includes a transmitter for transmitting messages to a plurality of receiving devices of the communication system, and a processing system. The processing system is adapted to convert a caller's voice message to a sequence of phonemes whereby the caller's voice message is intended for a receiving device. To accomplish the conversion, steps of Fourier transform, spectral subdivision, envelope filtering autocorrelation function determination of each subdivision, and voiceness determination for each subdivision are performed. The processing system is further adapted to generate a sequence of phoneme indexes and voice features corresponding to the sequence of phonemes, and to cause the transmitter to transmit the sequence of phoneme indexes to the receiving device for generating a voice signal representative of the caller's voice message. The voice features can include spectral features, average energy, duration, and pitch to improve the quality of the voice signal. The receiving device can be a selective call radio.

16 Claims, 6 Drawing Sheets

FIG. 2
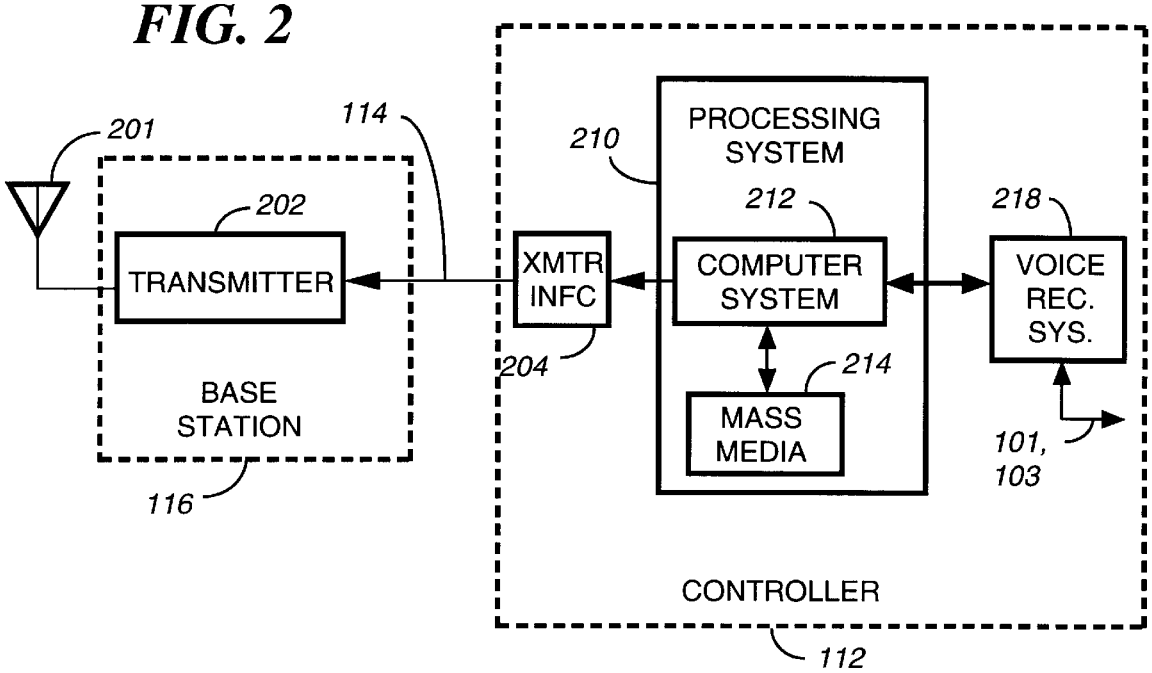
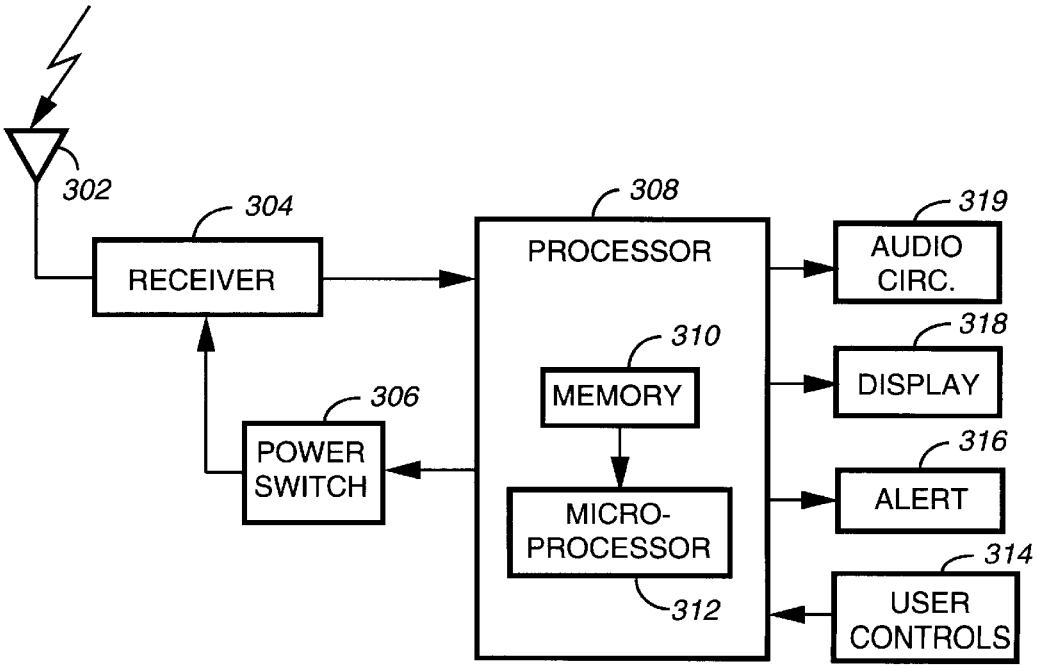
FIG. 3 122

400

417

VOICE COMPRESSION BY PHONEME RECOGNITION AND COMMUNICATION OF PHONEME INDEXES AND VOICE FEATURES

RELATED INVENTIONS

The present invention is related to the following inventions which are assigned to the same assignee as the present invention:

U.S. application Ser. No. 09/050,184 filed Mar. 30, 1998 by Andric et al., entitled "Voice Recognition System in a Radio Communication System and Method Therefor."

U.S. application Ser. No. 09/067,779, filed Apr. 27, 1999, mailed Apr. 23, 1998 by Cheng et al., entitled "Reliable Conversion of Voice in a Radio Communication System and Method Therefor."

FIELD OF THE INVENTION

This invention relates in general to communication systems, and particularly, to voice compression in a communication system.

BACKGROUND OF THE INVENTION

The use of voice compression algorithms in communication systems that transmit voice messages is well known in the art. These algorithms are used primarily to minimize air-time transmission, thereby increasing bandwidth utilization. As a result of improved bandwidth utilization, the service provider of the communication can provide service to a larger population of subscribers at a lower cost.

Generally, voice compression algorithms are used in communication systems to accomplish two goals: (1) to compress an caller's voice message to the extent that a minimal transmission bit rate is achieved, and (2) to allow a subscriber unit of the communication system to substantially replicate the caller's voice message according to the caller's original voice characteristics with minimal distortion.

Ordinarily, voice signals are sampled at a bit rate of 64,000 bits per second. The industry-wide voice compression standard known as VSELP (Vector Summation Excitation Linear Prediction) utilized by, e.g., cellular service providers, for example, provides a compression rate of 6400 bits per second. Hence, this algorithm compresses an ordinary voice signal by a factor of 10, which amounts to 10 times the capacity of a communication system utilizing no compression. In addition to furnishing this compression rate, the VSELP algorithm provides a method at the subscriber unit for substantially replicating the speaker's original voice characteristics, thereby permitting the user of the subscriber unit to recognize who the caller is without prior identification.

Clearly, VSELP, and other comparable compression algorithms, are useful in improving bandwidth utilization in a communication system. However, because these algorithms attempt to preserve the caller's original voice characteristics, the rate of compression achievable is substantially limited by the maximum degree of distortion desired during the uncompression process at the subscriber unit.

Accordingly, what is needed is an apparatus and method for compressing voice messages at substantially higher rates than is provided by present prior art voice compression algorithms.

BRIEF DESCRIPTION OF THE DRAWINGS

The present invention is pointed out with particularity in the appended claims. However, other features of the invention will become more apparent and best understood by referring to the following detailed description in conjunction with the accompanying drawings in which:

FIGS. 2 and 3 are electrical block diagrams of the fixed and portable portions of a radio communication system according to the present invention;

DESCRIPTION OF THE PREFERRED EMBODIMENT

Figure 1:
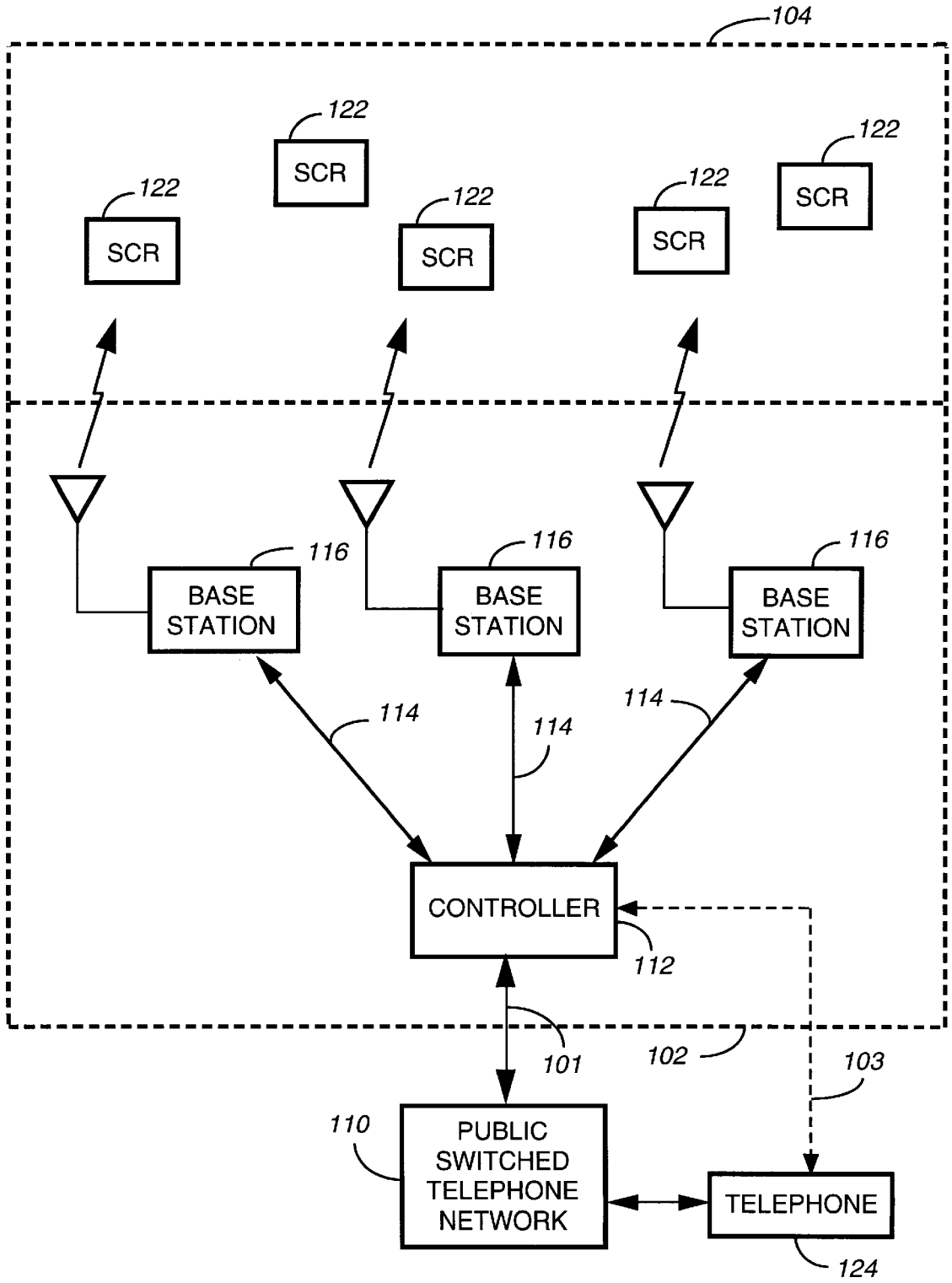
FIG. 1 is an electrical block diagram of a communication system according to the present invention.

FIG. 1 is an electrical block diagram of a communication system comprising a fixed portion 102 and a portable portion 104. The communication system is preferably a radio communication system. The fixed portion 102 includes a controller 112 for controlling operation of a plurality of base stations 116 by way of conventional communication links 114, such as microwave links. The portable portion 104 includes a plurality of receiving devices preferably comprising SCR's (selective call radios) 122 for receiving radio messages from the base stations 116 under the control of the controller 112. It will be appreciated that, alternatively, the radio communication system may be modified to support two-way communication between the SCR's 122 and the base stations 116. This modification may be achieved by the use of radio transceivers at both the SCR's 122 and the base stations 116.

It will be further appreciated that the communication system and the receiving devices may alternatively comprise a circuit switching communication system coupled to receivers for receiving messages therefrom. This alternative embodiment for the communication system and receiving devices would include analogous hardware elements and programmed instructions as are about to be described for the radio communication system and the SCRs 122 of FIG. 1.

Turning back to the discussion of FIG. 1, the controller 112 receives messages from callers utilizing a conventional telephone 124 for communicating with a conventional PSTN (public switch telephone network) 110. The PSTN 110 then relays messages to the controller 112 through a conventional telephone line 101 coupled to the controller 112. Upon receiving messages from the PSTN 110, the controller 112 processes the messages, and delivers them to the base stations 116 for transmission to designated SCR's 122. It will be appreciated that, alternatively, the telephone 124 may be directly coupled to the controller 112 by way of a conventional telephone line 103.

FIGS. 2 and 3 are electrical block diagrams of the fixed and portable portions 102, 104 of a radio communication system according to the present invention. The electrical block diagram of the fixed portion 102 includes the elements of the controller 112 and the base stations 116. The controller 112 comprises a conventional processing system 210 for controlling operation of the base stations 116, a voice recognition system 218, and a transmitter interface 204 for communicating messages to the base stations 116. The voice recognition system 218 receives voice messages from the PSTN 110, and/or from a direct telephone connection 103, and converts the voice messages to a sequence of phonemes as will be described below. The processing system 210 includes conventional hardware such as a computer system 212 (with built-in random access memory (RAM)—not shown in FIG. 2) and mass media 214 (e.g., a conventional hard disk) to perform the programmed operations of the controller 112. The base stations 116 comprise a conventional RF transmitter 202 coupled to an antenna 201 for transmitting the messages received from the controller 112.

A detailed discussion of the SCR 122 will be postponed until after the operation of the fixed portion 102 has been discussed. To begin this discussion, the reader is directed to FIGS. 5–6, which show flowcharts 400, 417 summarizing the operation of the radio communication system according to the present invention. The flowchart 400 depicts programmed instructions of the controller 112 which are initially stored in the mass media 214 and are then operated from the RAM included in the computer system 212.

Flowchart 400 begins with step 401 where a caller initiates communication with the radio communication system intending to send a message to a selected SCR 122. As noted earlier, this communication may originate from the PSTN 110 or a direct telephone connection 103 with the controller 112. In step 417, the caller's voice signal is converted to a sequence of phonemes by the voice recognition system 218. Alternatively, however, the processing system 210 may be programmed to perform this function as well.

As is commonly known by those of ordinary skill in the art, a phoneme represents the smallest quantum of sound used by a speaker for constructing a word. For example, the word "is" may be decomposed into two phoneme sounds: "ih" and "z." Thus, the sequence of phonemes generated in step 417 are representative of the phoneme content of the caller's voice message. In the present example, however, each phoneme from the sequence of phonemes derived from the caller's voice message will not carry speaker characteristics. That is, an audible playback of voice synthesized from the sequence of phonemes would not include sufficient audible information to allow a listener to determine who originated the voice message. The audible playback would, however, provide sufficient clarity and intelligibility to allow a listener to decipher the content of the voice message, i.e., what was said. A detailed discussion of the generation of the sequence of phonemes in step 417 will be discussed shortly according to the flowchart of FIG. 6.

After the sequence of phonemes has been generated in step 417, the processing system 210 proceeds to step 418 where it generates a sequence of phoneme indexes corresponding to the sequence of phonemes. A phoneme index is a pointer to a sequence of phoneme models stored in the SCR 122. Each pointer preferably identifies a particular phoneme model in the memory of the SCR 122, which is used by the SCR 122 for synthesizing the caller's voice message based on the sequence of phoneme indexes received. The synthesis process will be discussed shortly.

Generally, it takes 40 to 50 phonemes to account for all the words in the American English language, and most other languages as well. Since there is a limited number of phonemes in the English language, a phoneme index may be coded digitally by 6 binary bits, which allows for the identification of up to 64 possible phonemes—more than is necessary for this example. The digital representation of a phoneme model, however, requires a substantially higher number of bits. Therefore, it should be apparent that transmitting a phoneme index to a SCR 122 that stores a corresponding set of 40 to 50 phoneme models is an efficient method for optimizing system bandwidth.

As noted in step 418 the processing system 210 also generates voice features that correspond to each phoneme of the sequence of phonemes. The voice features are determined from a portion of the caller's voice message, and are intended to be used by the SCR 122 to modify the phoneme models stored in memory to improve the quality of the audible voice signal synthesized and played out by the SCR 122. Note, however, that the phoneme models are not permanently modified by the voice features of a particular caller—a point which will be further discussed in the operation of the SCR 122 below.

It will be appreciated that, alternatively, step 418 may be bypassed altogether, thereby requiring only transmission of the phoneme indexes to the SCR 122. Under this embodiment, a significant compression rate can be achieved. Assuming voice features are transmitted to the SCR 122, however, voice features for a corresponding phoneme preferably comprise spectral features of at least a portion of the corresponding phoneme, an average energy level of the corresponding phoneme, a duration of the corresponding phoneme, and a pitch period representative of a periodicity of the corresponding phoneme.

Spectral features may comprise any number of possible speech features. For example, spectral features may be represented by conventional linear prediction coefficients (LPC) or conventional line spectrum pairs (LSP). Alternatively, spectral features may be represented by the combination of an average magnitude of spectral data of at least a portion of the caller's voice message, and the magnitude of an autocorrelation function derived from the same portion. This latter magnitude is explained in detail in step 410 of the flowchart of FIG. 6, which will be discussed shortly.

The average energy level of the corresponding phoneme is representative of the average energy level of the caller's voice signal in the time domain, and is determined by conventional methods well-known in the art. Both the duration of a phoneme and a phoneme's pitch period, which is representative of the periodicity of the phoneme, comprise speech information well known to those of ordinary skill in the art, and is determined by conventional methods programmed into the processing system 210.

Table 1 below shows a breakdown of the number of bits necessary for transmitting a phoneme index and corresponding voice features.

TABLE 1

| | Phoneme Index | Voice Features: Spectral Features | Phoneme Duration | Average Energy Level | Phoneme Pitch Period | Total Binary Bits |
|---|---|---|---|---|---|---|
| Total Bits/ Phoneme | 6 | 8 | 3 | 5 | 4 | 26 |
| Total Bit Rate | 42 | 56 | 21 | 35 | 28 | 182 |

As noted earlier, only 6 bits are necessary for representing one of 40 to 50 possible phonemes. For the present example, a spectral feature is preferably a LSP vector. With an 8 bit code, any one of 256 LSP vectors may be identified by the SCR 122 upon receiving a phoneme index. Quantization into a limited range of 256 possible vectors is clearly preferable to the alternative of transmitting an infinite number of real numbers. Based on this rationale, quantization is also applied to the factors that identify the phoneme's duration, the average energy level in the phoneme, and phoneme's pitch period. In the present example, the phoneme duration has been quantized to 8 levels, the average energy level of a phoneme to 32 levels, and the phoneme pitch period to 16 levels. In total, each transmission of a phoneme index and corresponding voice features requires 26 bits.

It is well known in the art that, generally, an individual utters about 7 phonemes per second. Applying this rate to the first row of Table 1, we find that the total bit rate for transmitting phoneme indexes and their corresponding voice features is 182 bits per second, as indicated by the second row of Table 1. At this rate, the caller's voice message may be synthesized at an SCR 122 at a quality level that substantially allows a user of the SCR 122 to hear an intelligible message.

It will be appreciated that other voice features suitable to the present invention may be used independently or in conjunction with the features just described. It will also be appreciated the use of other voice features may result in higher or lower compression rates. Additionally, it will be appreciated that in the embodiment where only phoneme indexes are transmitted to the SCR 122, the compression rate may be as low as 42 bits per second which is substantially better than any known prior art compression system. At this compression rate, transmitting phoneme indexes has a compression efficiency indistinguishable from that of transmitting alpha-numeric messages.

Figure 5:
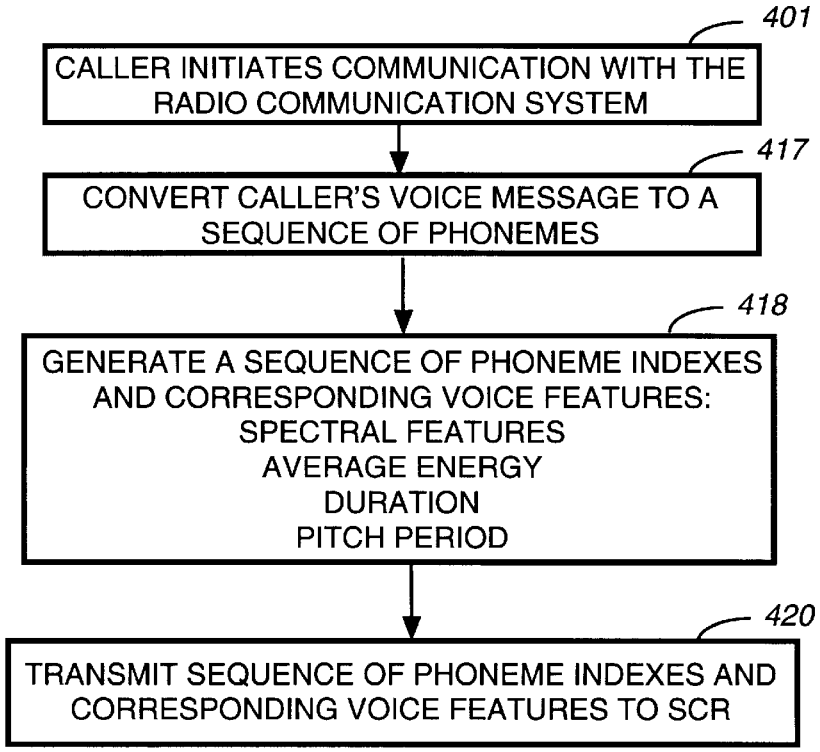
FIGS. 5–6 show flowcharts summarizing the operation of the radio communication system according to the present invention.
Figure 6:
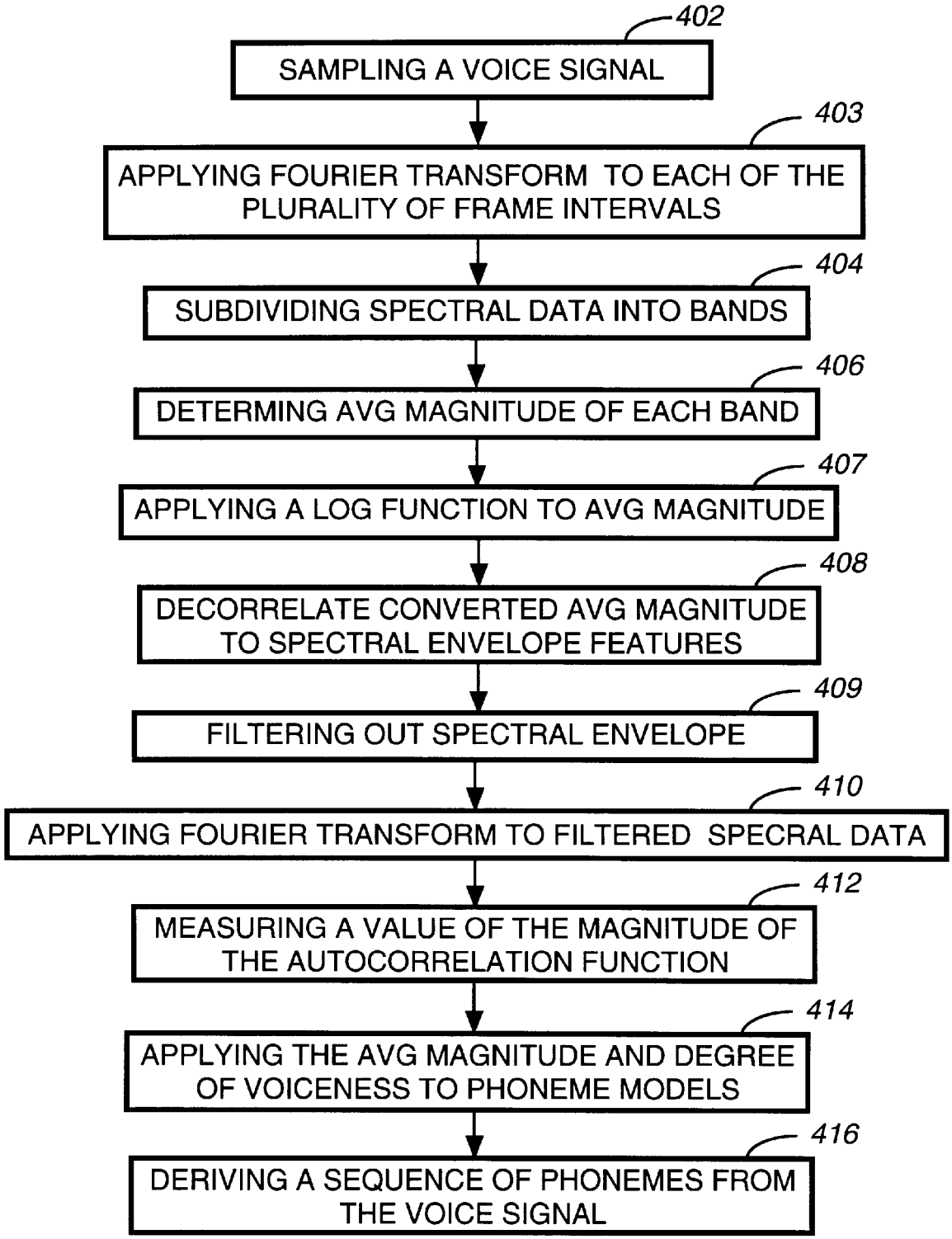

Finally, turning back to the flowchart of FIG. 5, once the sequence of phoneme indexes and corresponding voice features have been determined, the processing system 210 proceeds to step 420 where it transmits them to the SCR 122 for later synthesis into a voice signal representative of the caller's voice message generated in step 401. Although the present invention is not limited in scope to a single type of voice recognition system, the flowchart of FIG. 6 illustrates a preferred embodiment of the voice recognition system 218 of FIG. 2. This embodiment provides a high degree of accuracy in deriving the sequence of phonemes corresponding to the caller's voice message. It will be appreciated that the processing system 210 may be programmed to perform the steps shown in FIG. 6 as an alternative to utilizing the dedicated voice recognition system 218 as shown in FIG. 2.

Figure 7:
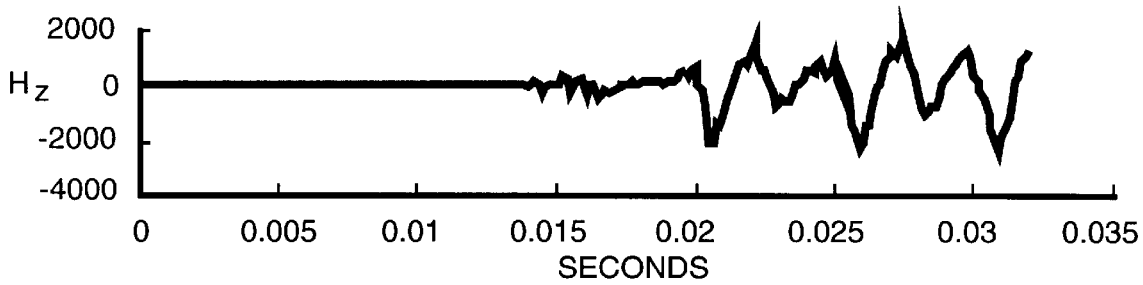
FIGS. 7–10 show graphs representative of the transformations made to voice signals generated by a caller according to the present invention.
Figure 8:
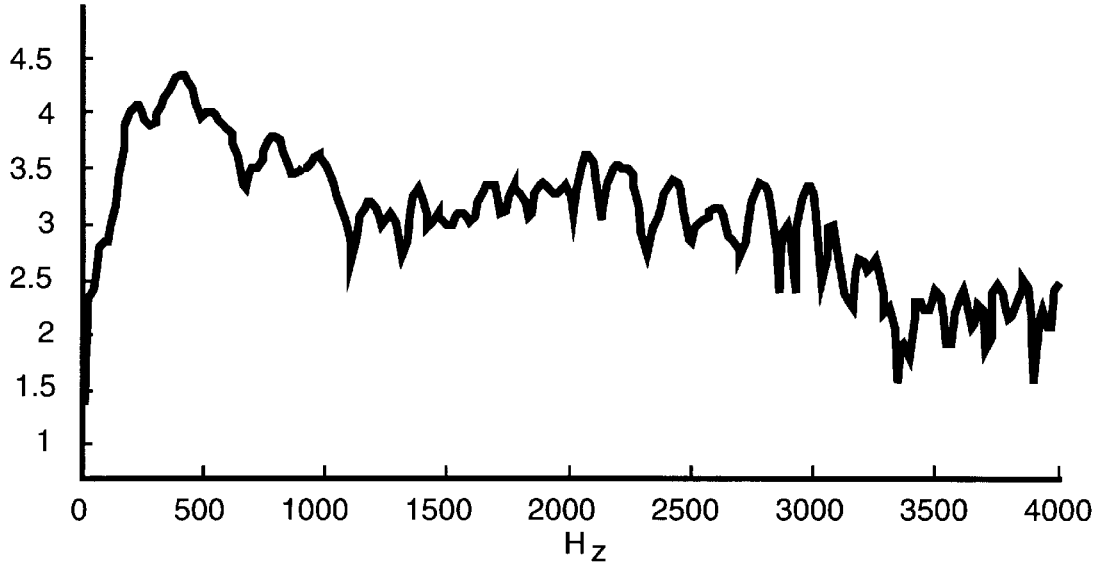

The process of converting voice to a sequence of phonemes begins with step 402 where a voice signal originated by a caller in step 401 is sampled. An illustration of a voice signal is shown in FIG. 7. In step 403 the processing system 210 is programmed to apply a Fourier transform to a plurality of frame intervals of the sampled voice signal (e.g., 10–25 ms) to generate spectral data having a spectral envelope for each of the plurality of frame intervals. The Fourier transform applied in this step is preferably a fast Fourier transform. The spectral signal over a frame interval is shown in FIG. 8. Assuming the input speech signal is represented by $x_n$, the following equation describes the result of step 403:

$$P_k = \sum_{n=0}^{N-1} x_n e^{-j\frac{2\pi nk}{N}},$$

where $0 \leqq k \leqq N-1$.

In step 404, for each of the plurality of frame intervals, the spectral data is subdivided into a plurality of bands, each of the plurality of bands having a predetermined bandwidth (e.g., 400 Hz). It will be appreciated that, alternatively, each band have a variable bandwidth. In step 406, the processing system 210 determines an average magnitude of the spectral data for each of the plurality of bands. Then in step 407 a logarithmic function is applied to the average magnitude to generate a converted average magnitude. In step 408, the converted average magnitude is then decorrelated (preferably with a discrete cosine transform) to generate spectral envelope features.

The controller 112 then proceeds to step 409 to filter out the spectral envelope from the spectral data of each of the plurality of frame intervals to generate filtered spectral data for each of the plurality of frame intervals. This step preferably comprises the steps of averaging the spectral data of each of the plurality of frame intervals to generate a spectral envelope estimate, and subtracting the spectral envelope estimate from the spectral data. These steps are substantially represented by the function, $$P'_k = f(i) * P_k, \text{ wherein } f(i) = \begin{cases} 1 & 0 \le i < L \\ -1 & -L < i < 0 \end{cases}.$$

Figure 9:
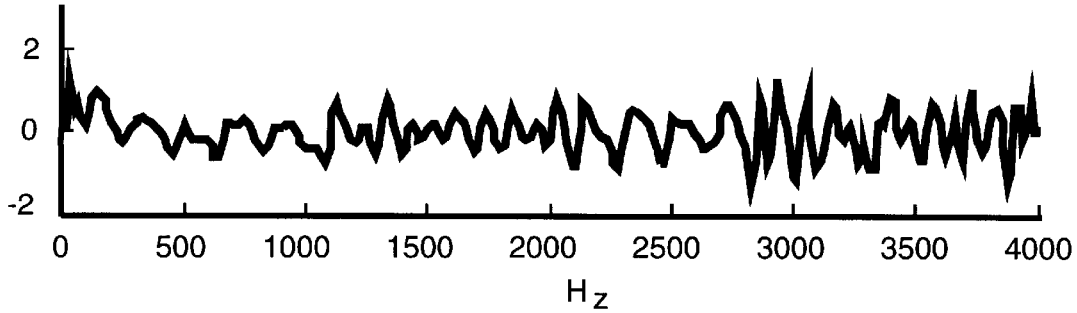

The function f(i) is a 1-D Haar function well known in the art, and $P'_k$ is the convolution of the Haar function with the original spectral data $P_k$. The result of filtering the spectral data is shown in FIG. 9.

Next, in step 410, a fast Fourier transform is applied to the filtered spectral data for each of the plurality of bands to generate an autocorrelation function for each of the plurality of bands. If there is a strong harmonic structure in the original spectral data, the autocorrelation function for each of the plurality of bands will have a high peak value around the value of its pitch period. For this reason, each autocorrelation function is preferably normalized by its corresponding spectral band energy. In step 412, the controller 112 proceeds to measure a value of the magnitude of the autocorrelation function for each of the plurality of bands. The value of the magnitude of the autocorrelation function is defined as a measure of a degree of voiceness for each of the plurality of bands.

There are two embodiments for measuring a value of the magnitude of the autocorrelation function. In a first embodiment, the value of the magnitude of the autocorrelation function corresponds to a peak magnitude of the autocorrelation function. Alternatively, in a second embodiment, for each of the plurality of frame intervals, the value of the magnitude of the autocorrelation function for each of the plurality of bands is determined by: (1) summing the autocorrelation function of each of the plurality of bands to generate a composite autocorrelation function, (2) determining a peak magnitude of the composite autocorrelation function, (3) determining from the peak magnitude a corresponding frequency mark, and (4) utilizing the corresponding frequency mark to determine a corresponding magnitude value for each of the plurality of bands.

Figure 10:
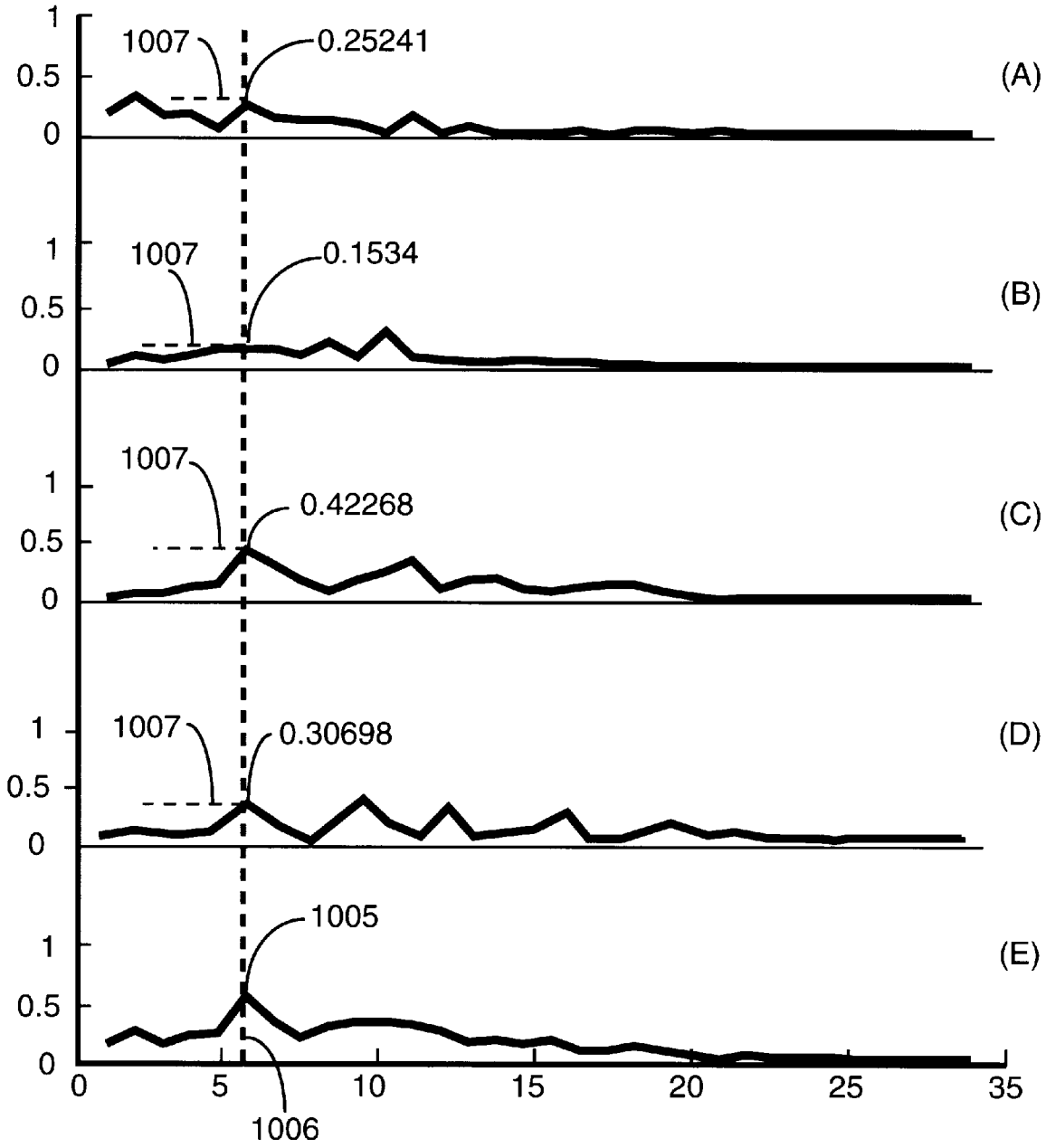

The second embodiment is illustrated in FIG. 10. Graphs (a)–(d) represent the autocorrelation function for each of bands 1–4. Graph (e) is the composite autocorrelation function as a result of summing the autocorrelation functions of bands 1–4. From the composite autocorrelation function a peak magnitude 1005, and a corresponding frequency mark 1006 is determined. The corresponding frequency mark 1006 is then used to determine a corresponding magnitude value 1007 for each of the plurality of bands as shown in graphs (a)–(d).

As noted earlier, the value of the magnitude of the autocorrelation function is a measure of the degree of voiceness for each of the plurality of bands. After determining the degree of voiceness for each of the plurality of bands by either of the foregoing embodiments, in step 414, the spectral envelope features determined in step 408 and the degree of voiceness just discussed is applied to a corresponding plurality of phoneme models. Phoneme models are known in the art as models of speech determined from statistical modeling of human speech. In the art, phoneme models are also commonly referred to as Hidden Markov Models.

As noted earlier, a phoneme represents the smallest quantum of sound used by a speaker for constructing a word. Since individuals of differing cultures may speak with differing dialects, the word "is", for example, may have more than one set of phoneme models to represent mismatched populations. For example, there may be individuals who end the word "is" with a "s" sound, i.e., "ih" and "s", in contrast to other populations which may sound out the word "is" with the phonemes "ih" and "z".

As a preferred embodiment, the phoneme models are determined over a large population of samples of human speech, which accounts for varying pronunciations based on varying speech dialectics. Deriving phoneme models from a large population allows for the present invention to operate as a speaker-independent voice recognition system. That is, the phoneme models are not dependent on a particular speaker's voice. With speaker-independent descriptions built into a phoneme model library, the controller 112 of the radio communication system can convert the voice of any speaker nation-wide to a sequence of phonemes without prior training of the caller's voice. It will be appreciated, however, that the present invention may be altered so that a phoneme library may be constructed from training provided by one or more specific human speakers, thereby forming a speaker-dependent phoneme library. Notwithstanding this alternative embodiment, the ensuing discussions will focus on a speaker-independent phoneme library.

Based on a speaker-independent phoneme library, the conversion of voice into a sequence of phonemes, as indicated by step 416, is accomplished by comparing the spectral envelope features of the spectral data for each of the plurality of bands and the degree of voiceness for each of the plurality of bands with a library of speaker-independent phoneme models. From this comparison, a sequence of likely phonemes are identified. As part of the comparison processes for determining one or more likely phonemes, the following probability function is preferably used:

$$b_j(o_t) = \prod_{s=1}^{S} \left[ \sum_{m=1}^{M_s} c_{jsm} N\left(o_{st}; \mu_{jsm}, \sum_{jsm}\right) \right]^{\gamma_s},$$

wherein $M_s$ is the number of mixture components in stream s. The variable S for the present invention is equal to 2, which represents the product of two probabilities. That is, one product represents the likelihood of a matched set of phoneme models based on the spectral envelope features of the spectral data per band, and another product represents the likelihood of a matched set of phoneme models based on the degree of voiceness per band. The variable $c_{jsm}$ is a weighting factor, while the function N is a multivariate Gaussian function, wherein the variable $o_{st}$ is input data vectors representative of the spectral envelope features and degree of voiceness for each of the plurality of bands, and wherein $u_{jsm}$ and $\Sigma_{jsm}$ are the mean and covariance vectors of each of the phoneme models in the phoneme library. Lastly, the variable $\gamma_s$ is used for providing differing weights to the probability result representative of the spectral envelope features versus the probability result representative of the degree of voiceness. For example, the spectral envelope features probability result may be given a weight of 1.00 while the degree of voiceness probability result may be given a weight of 1.20. Hence, more importance is given to the outcome derived from the use of degree of voiceness data rather than the spectral envelope features data. It will be appreciated that any weight may be given to either product depending on the application in which the present invention is utilized.

Each of the probability results ($b_j$) is then compared over a stream of the plurality of frames to determine a sequence of phonemes representative of the caller's voice message. In the event the comparison process leads to one or more possible sequences of phonemes, the sequence of phonemes with the greatest likelihood of success is chosen according to a composite probability result for each branch. Once the sequence of phonemes with the greatest likelihood of success has been chosen, the controller 112 proceeds to steps 418–420 of FIG. 5 as discussed earlier.

A detailed description of the foregoing equation (represented by $b_j$) to predict the likelihood of a stream of phonemes is more fully described in Steve Young, "The HTK Book," Entropic Cambridge Research Laboratory, Cambridge CB3 OAX, England, which is hereby incorporated herein by reference. Additionally, the reader is directed to the following introductory materials related to voice recognition systems, which are described in Joseph Picone, "Continuous Speech Recognition Using Hidden Markov Models," IEEE ASSP Magazine, July 1990, pp. 26–40, and Yves Normandin, "High-Performance Connected Digit Recognition Using Maximum Mutual Information Estimation,"

IEEE Transactions on Speech and Audio Processing, Vol. 2, No. 2, April 1994, respectively, which are hereby incorporated herein by reference.

Having summarized the fixed portion 102 of the radio communication system, the reader's attention is now directed to FIG. 3, which shows an electrical block diagram of the SCR 122 according to the present invention. The SCR 122 comprises a receiver 304 coupled to an antenna 302, a power switch 306, a processor 308, an alerting device 316, a display 318, and user controls 314. The receiver 304 and antenna 302 are conventional RF elements for receiving messages transmitted by the base stations 116. The power switch 306 is a conventional switch, such as a MOS (metal oxide semiconductor) switch for controlling power to the receiver 304 under the direction of the processor 308, thereby providing a battery saving function.

The processor 308 is used for controlling the operation of the SCR 122. Generally, its primary function is to decode and process demodulated messages provided by the receiver 304, storing them, alerting a user of the received message and playing out the received message on the audio circuit 319 upon request from the user. To perform this function, the processor 308 comprises a conventional microprocessor 312 coupled to a conventional memory 310 including nonvolatile and volatile memory portions, such as a ROM (read-only memory) and RAM (random-access memory), respectively.

One of the uses of the memory 310 is for storing messages received from the base stations 116 in the RAM. Another use is for storing programmed instructions in the ROM that determine the operation of the processor 308, and for storing one or more selective call addresses in the ROM for identifying incoming messages belonging to the SCR 122. Yet another use is for storing tables used for synthesizing the messages received from the base stations 116 into audible voice messages played out on the audio circuit 319. These tables are preferably stored in the ROM section of the memory 310.

Once a message has been decoded and stored in the memory 310, the processor 308 activates the alerting device 316 which generates a tactile and/or audible alert signal to the user. With the display 318, which is, for example, a conventional LCD (liquid crystal display) and conventional user controls 314, the user may determine which of the received messages the user may want to hear first.

Figure 4:
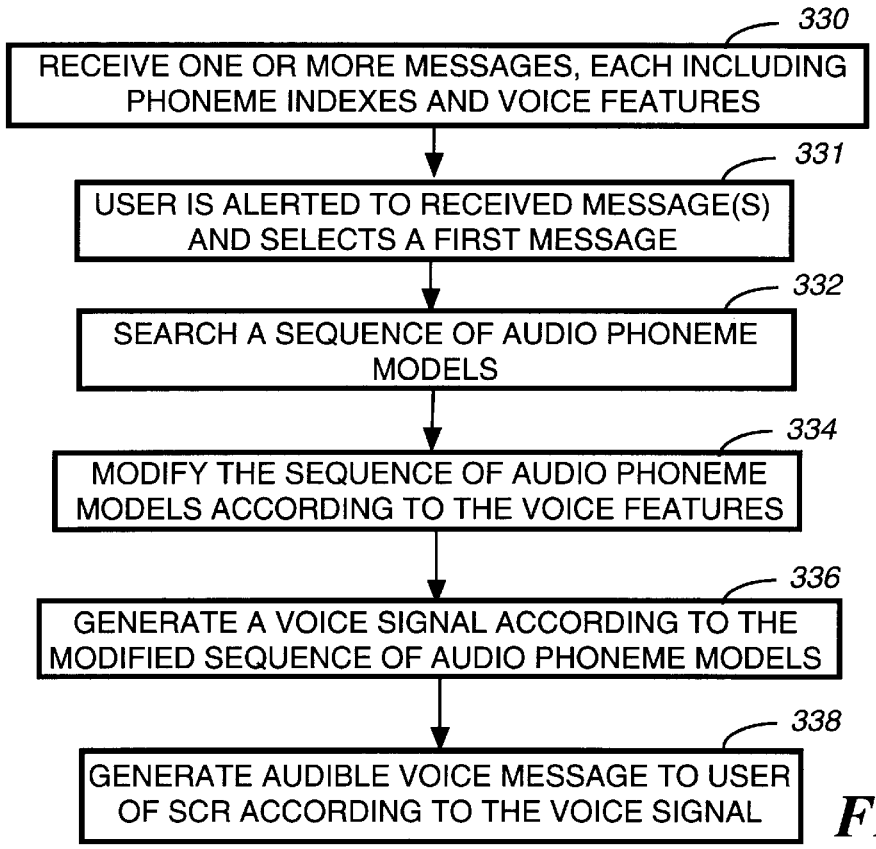
FIG. 4 shows a flowchart summarizing the operation of a SCR (selective call radio) of the radio communication system according to the present invention.

To fully describe the operation of the SCR 122, FIG. 4 provides a flowchart that depicts the steps performed by the SCR 122 to process a voice message received from the fixed portion 102 of the radio communication system according to the present invention. These steps are preferably programmed into the ROM portion of the memory 310. Beginning with step 330, the processor 308 is adapted to cause the receiver 304 to receive from the fixed portion 102 of the radio communication system one or more messages that each include a sequence of phoneme indexes and corresponding voice features representative of a caller's voice message. Alternatively, it will be appreciated that the SCR 122 may receive instead only the sequence of phoneme indexes. This alternative embodiment may be used in an application which calls for a high degree of compression.

Once the sequence of phoneme indexes and corresponding voice features have been received and stored in the RAM section of the memory 310, the processor 308 proceeds to step 331 where it alerts the user of the SCR 122 that one or more messages have been received. This is done by activating the alerting device 316 which generates a tactile and/or audible alert for provoking the attention of the user of the SCR 122. The user then selects one of the received messages by way of the user controls 314 in a conventional manner.

After a message has been selected, the processor 308 proceeds to step 332. In this step, the processor 308 reads the sequence of phoneme indexes stored in the RAM, and then searches through the ROM section of the memory 310 for a corresponding sequence of phoneme models. The sequence of phoneme models is derived from a plurality of predetermined phoneme models stored in the ROM. The reader may recall from the discussion of the fixed portion 102 of the radio communication system that words in the English language can be described from a list of 40 to 50 phonemes. Assuming for this example that the fixed portion 102 utilizes a list of 40 phonemes, then the plurality of predetermined phoneme models stored in the ROM are representative of 40 predetermined phoneme models.

It should be noted that the predetermined phoneme models stored in the ROM of the SCR 122 are not identical to the phoneme models used by the radio communication system described above. Rather, the predetermined phoneme models stored in the ROM are intended for voice synthesis of the sequence of phoneme indexes received from the radio communication system, while the phoneme models stored in the memory of the processing system 210 are intended for voice recognition of the caller's voice message. Additionally, each of the plurality of predetermined phoneme models of the SCR 122 represents a speaker-independent phoneme model. This means that an audio playback of a selected sequence of phoneme models representative of a caller's voice message provides a synthesized audible voice signal that does not permit the user of the SCR 122 to recognize who a caller may be simply based on voice characteristics, unless the user of the SCR 122 is able to identify the caller by the context of the message, or by the caller identifying herself in the message. However, the audible voice signal has sufficient intelligibility to allow the user of the SCR 122 to determine the content of a caller's message.

Once the processor 308 has identified a corresponding sequence of phoneme models, the processor 308 proceeds to step 334 where it modifies each phoneme model of the sequence of phoneme models according to the voice features of each corresponding phoneme index. It will be appreciated that, alternatively, this step may be eliminated, whereby the processor 308 proceeds to step 336 and generates a voice signal according to an unmodified sequence of phoneme models corresponding to the sequence of phoneme indexes received. Although this alternative embodiment furnishes a lower quality voice signal, it still provides a user of the SCR 122 an intelligible message. However, to improve the quality of the voice signal generated in step 336, the sequence of phoneme models is preferably modified in a conventional manner according to the voice features received for each phoneme to approximate to some degree the caller's original voice characteristics.

To optimize the required size of the RAM section of the memory 310, the modification of the sequence of the phoneme models is preferably performed by reading one phoneme model from the ROM at a time, modifying the phoneme model in RAM, playing out the modified phoneme model by way of the audio circuit 319, and reusing the same section of the RAM to modify a subsequent phoneme model. According to this method, a minimal amount of scratch pad area is need for the RAM section of the SCR 122. Instead the primary function of the RAM would be for storing the sequence of phoneme indexes and corresponding voice features. Every instance that the user of the SCR 122 selects to playout a message, the modification process would be performed as described above. It will be appreciated, however, that alternatively the RAM size can be chosen so as to store a modified sequence of phoneme models, thereby providing virtually instant playback capability for the user of the SCR 122.

As noted in Table 1 above, the voice features for each phoneme comprise an 8 bit index for spectral features, a 3 bit index for phoneme duration, a 5 bit index for average energy level in the phoneme, and a 4 bit index for the phoneme's pitch period. In the case of the spectral features, which are preferably represented by LSP vectors (of, e.g., 10 coefficients per vector requiring 4 bytes of memory per coefficient), there are 256 possible vectors per phoneme. With a total of 40 possible phonemes, 409,600 bytes (10 coefficients * 4 bytes per coefficient * 256 vectors per phoneme * 40 possible phonemes) of RAM memory is needed to store all the possible spectral features. In addition, 2240 bytes are required for storing the possible phoneme durations (1 byte * 8 levels per phoneme * 40 phonemes), average energy levels (1 byte * 32 levels per phoneme * 40 phonemes), and phoneme pitch periods (1 byte * 16 levels per phoneme * 40 phonemes). The data of Table 1 are preferably stored in the ROM section of the memory 310, because this data is invariable and because it is the least expensive portion of the memory 310.

Once the sequence of phoneme models determined in step 332 have been modified by the voice features discussed above in step 334, the processor 308 proceeds to step 336 where it generates a voice signal according to the modified sequence of phoneme models. The voice signal is then applied to the audio circuit 319 in step 338 to generate an audible voice message representative of the caller's voice message. It will be appreciated that, alternatively, steps 332–336 may be performed by a conventional synthesizer circuit (not shown) that is programmed to perform the steps described above.

The foregoing method and apparatus described for the communication system and receiving devices 122 are substantially advantages over prior art systems. In the present invention, compression rates as low as 42 bits per second may be achieved when only phoneme indexes are transmitted to the SCR's 122. In an alternative embodiment, voice features are transmitted along with the phoneme indexes to further enhance the quality of the voice signal generated at the SCR 122, thereby achieving bit compression rates as low as 182 bits per second. In either embodiment, these compression rates are substantially lower than the bit compression rates available with conventional voice compression algorithms today.

Although the invention has been described in terms of a preferred embodiment it will be obvious to those skilled in the art that many alterations and variations may be made without departing from the invention. Accordingly, it is intended that all such alterations and variations be considered as within the spirit and scope of the invention as defined by the appended claims.

What is claimed is:

1. In a communication system, a method comprising the steps of:

converting a caller's voice message to a sequence of phonemes, whereby the caller's voice message is intended for a receiving device of the communication system;

generating a sequence of phoneme indexes corresponding to the sequence of phonemes;

generating corresponding voice features for each phoneme of the sequence of phonemes, wherein the voice features are determined from the caller's voice message; and transmitting the sequence of phoneme indexes and corresponding voice features to the receiving device for generating a voice signal representative of the caller's voice message, wherein the corresponding voice features comprise:

spectral features of at least a portion of the corresponding phoneme;

an average energy level of the corresponding phoneme;

a duration of the corresponding phoneme; and a pitch period representative of a periodicity of the corresponding phoneme.

2. The method as recited in claim 1, wherein the converting step comprises the steps of:

sampling a voice signal;

applying a Fourier transform to a plurality of frame intervals of the sampled voice signal to generate spectral data having a spectral envelope for each of the plurality of frame intervals;

subdividing the spectral data for each of the plurality of frame intervals into a plurality of bands;

filtering out the spectral envelope from the spectral data of each of the plurality of frame intervals to generate filtered spectral data for each of the plurality of frame intervals;

applying a Fourier transform to the filtered spectral data for each of the plurality of bands to generate an autocorrelation function for each of the plurality of bands;

measuring a value of the magnitude of the autocorrelation function for each of the plurality of bands, whereby the value is a measure of a degree of voiceness for each of the plurality of bands;

applying the degree of voiceness for each of the plurality of bands to a corresponding plurality of phoneme models; and deriving the sequence of phonemes from the voice signal by searching through a phoneme library according to predictions made by the corresponding plurality of phoneme models.

3. The method as recited in claim 7, further comprising the steps of:

determining an average magnitude for each of the plurality of bands;

applying a logarithmic function to the average magnitude to generate a converted average magnitude;

decorrelating the converted average magnitude to generate spectral envelope features; and applying the spectral envelope features for each of the plurality of bands to the corresponding plurality of phoneme models.

4. The method as recited in claim 2, wherein the value of the magnitude of the autocorrelation function is a peak magnitude.

5. The method as recited in claim 2, wherein for each of the plurality of frame intervals, the value of the magnitude of the autocorrelation function for each of the plurality of bands is determined by:

summing the autocorrelation function of each of the plurality of bands to generate a composite autocorrelation function;

determining a peak magnitude of the composite autocorrelation function;

determining from the peak magnitude a corresponding frequency mark; and utilizing the corresponding frequency mark to determine a corresponding magnitude value for each of the plurality of bands.

6. The method as recited in claim 2, wherein the Fourier transform comprises a fast Fourier transform.

7. The method as recited in claim 1, wherein the communication system is a radio communication system, and wherein the receiving device is a SCR (selective call radio).

8. In a receiving device, a method comprising the steps of:

receiving from a communication system a sequence of phoneme indexes representative of a caller's voice message;

receiving voice features corresponding to each phoneme index of the sequence of phoneme indexes, wherein the voice features for each phoneme index are representative of a corresponding phoneme derived from the caller's voice message;

searching for a sequence of phoneme models corresponding to the sequence of phoneme indexes, wherein the sequence of phoneme models are derived from a plurality of predetermined phoneme models;

modifying each phoneme model of the sequence of phoneme models according to the voice features of each phoneme index; and generating an audible voice message representative of the caller's voice message according to the sequence of modified phoneme models, wherein the voice features for the corresponding phoneme comprise:

spectral features of at least a portion of the corresponding phoneme;

an average energy level of the corresponding phoneme;

a duration of the corresponding phoneme; and a pitch period representative of a periodicity of the corresponding phoneme.

9. The method as recited in claim 8, wherein the communication system is a radio communication system, and wherein the receiving device is a SCR (selective call radio).

10. A communication system, comprising:

a transmitter for transmitting messages to a plurality of receiving devices coupled to the communication system; and a processing system coupled to the transmitter, wherein the processing system is adapted to:

convert a caller's voice message to a sequence of phonemes, whereby the caller's voice message is intended for a receiving device;

generate a sequence of phoneme indexes corresponding to the sequence of phonemes;

generate voice features corresponding to each phoneme of the sequence of phonemes, wherein the voice features are determined from a portion of the caller's voice message; and cause the transmitter to transmit the sequence of phoneme indexes and the corresponding voice features to the receiving device for generating a voice signal representative of the caller's voice message, wherein the voice features for a corresponding phoneme comprise:

spectral features of at least a portion of the corresponding phoneme;

an average energy level of the corresponding phoneme;

a duration of the corresponding phoneme; and a pitch period representative of a periodicity of the corresponding phoneme.

11. The communication system as recited in claim 10, wherein the processing system is adapted to cause a voice recognition system to perform the converting step and the generating step.

12. The communication system as recited in claim 10, wherein the step of converting the caller's voice message to the sequence of phonemes includes the steps of:

sampling a voice signal generated by a caller during a plurality of frame intervals, wherein the voice signal is representative of a message intended for the receiving device;

applying a Fourier transform to a plurality of frame intervals of the sampled voice signal to generate spectral data having a spectral envelope for each of the plurality of frame intervals;

subdividing the spectral data for each of the plurality of frame intervals into a plurality of bands;

filtering out the spectral envelope from the spectral data of each of the plurality of frame intervals to generate filtered spectral data for each of the plurality of frame intervals;

applying a Fourier transform to the filtered spectral data for each of the plurality of bands to generate an autocorrelation function for each of the plurality of bands;

measuring a value of the magnitude of the autocorrelation function for each of the plurality of bands, whereby the value is a measure of a degree of voiceness for each of the plurality of bands;

applying the degree of voiceness for each of the plurality of bands to a corresponding plurality of phoneme models; and deriving the sequence of phonemes from the voice signal by searching through a phoneme library according to predictions made by the corresponding plurality of phoneme models.

13. The communication system as recited in claim 10, wherein the communication system is a radio communication system, and wherein the receiving device is a SCR (selective call radio).

14. A receiving device, comprising:

a receiver;

a memory;

an audio circuit; and a processor coupled to the receiver, the memory, and the audio circuit, wherein the processor is adapted to:

cause the receiver to receive from a communication system a sequence of phoneme indexes representative of a caller's voice message;

cause the receiver to receive from the communication system voice features for each phoneme index of the sequence of phoneme indexes, wherein the voice features for each phoneme index are representative of a corresponding phoneme derived from the caller's voice message;

search in the memory for a sequence of phoneme models corresponding to the sequence of phoneme indexes, wherein the sequence of phoneme models are derived from a plurality of predetermined phoneme models stored in the memory;

modify each phoneme model of the sequence of phoneme models according to the voice features of each corresponding phoneme index;

generate a voice signal according to the sequence of modified phoneme models; and cause the audio circuit to generate an audible voice message in response to the voice signal, wherein the audible voice message is representative of the caller's voice message, wherein the voice features for the corresponding phoneme comprise:

spectral features of at least a portion of the corresponding phoneme;

an average energy level of the corresponding phoneme;

a duration of the corresponding phoneme; and a pitch period representative of a periodicity of the corresponding phoneme.

15. The receiving device as recited in claim 14, wherein the processor is adapted to cause a synthesizer circuit to perform the generating step.

16. The receiving device as recited in claim 14, wherein the communication system is a radio communication system, and wherein the receiving device is a SCR (selective call radio).

* * * * *